United States Patent [19]

Mullins

[11] Patent Number: 4,881,737

[45] Date of Patent: Nov. 21, 1989

[54] TRUE ROLL PUTTER

[76] Inventor: Billy J. Mullins, 2009 11th St., Wichita Falls, Tex. 76301

[21] Appl. No.: 307,926

[22] Filed: Feb. 9, 1989

[51] Int. Cl.[4] ..... A63B 53/02; A63B 53/04

[52] U.S. Cl. ..... 273/80 A; 273/167 C; 273/175; 273/83; 273/80.1; D21/217

[58] Field of Search ..... 273/167–175, 273/77 R, 79, 80 A, 80 C, 80.1, 67 R, 67 C, 56, 83; D21/210, 214, 215–219; D8/77; 81/19, 25

[56] References Cited

U.S. PATENT DOCUMENTS

| | | | |
|---|---|---|---|
| D. 5,556 | 2/1872 | Pettengill | D8/77 X |
| D. 187,658 | 4/1960 | Holdstein | D21/210 |
| D. 276,452 | 11/1984 | Doman | D21/218 |
| 393,789 | 12/1888 | Runnals | 81/19 |
| 495,607 | 4/1893 | Barney | 81/19 |
| 2,755,833 | 7/1956 | Quayle | 81/19 X |
| 3,226,120 | 12/1965 | Borah | 273/168 X |
| 3,394,937 | 7/1968 | Allport | 273/175 |
| 3,430,957 | 3/1969 | Andis | 273/80.1 |
| 4,508,342 | 4/1985 | Drake | 273/167 C |
| 4,569,523 | 2/1986 | Jarvis | 273/80.1 X |

*Primary Examiner*—Edward M. Coven
*Assistant Examiner*—S. Passaniti
*Attorney, Agent, or Firm*—Fleit, Jacobson, Cohn, Price, Holman & Stern

[57] ABSTRACT

An elongated generally cylindrical head is provided with an upstanding handle shaft inclined between 16° and 22° relative to a vertical plane normal to the longitudinal center line of the head. The shaft is connected to the head for adjustment of the incline of the shaft relative to the shaft and the lower extremities of the opposite ends of the head are disposed in a horizontal plane spaced below the lower extremity of the longitudinal mid-portion of the head. In addition, the opposite ends of the head each includes alternating large and small diameter zones spaced longitudinally of the head which function to rapidly diminish the amplitude of vibrations of the head, travelling both transversely and longitudinally thereof, resulting from impact of either side of the head with a golf ball.

18 Claims, 1 Drawing Sheet

TRUE ROLL PUTTER

BACKGROUND OF THE INVENTION

1. FIELD OF THE INVENTION

This invention relates to a putter including a generally cylindrical club head and an upstanding inclined shaft or handle adjustable in inclination relative to the club head between 16°and 22° relative to a vertical plane disposed normal to the center axis of the club head. The putter is usable by both right and left handed persons and the head of the club includes a center of gravity spaced at least slightly below the longitudinal center axis of the head and incorporates a generally cylindrical center section and generally cylindrical opposite end sections coaxial with the center section, the end sections each including alternating small and large diameter zones spaced longitudinally along the club head. The alternating large and small diameter zones of the club head ends serve to quickly diminish the amplitude of vibrations of the head travelling both longitudinally and laterally of the head, resulting from the club head striking a golf ball.

2. DESCRIPTION OF RELATED ART

Various different forms of putters including generally cylindrical heads and heads including partial cylindrical ball striking surfaces heretofore have been provided such as those disclosed in U.S. Pat. Nos. 1,525,137, 1,409,966, 2,665,909, 3,394,937, 3,700,244, 3,989,257, 4,121,833 and 4,508,342 as well as U.S. Des. Pat. Nos. D138,380, D156,963, D188,280, D234,524 and D276,452. However, these previously known forms of putters do not include the overall combination of structural and operational features incorporated in the instant invention.

SUMMARY OF THE INVENTION

The putter of the instant invention has been specifically designed to enable the handle or shaft thereof to be adjustably inclined relative to the head. Further, the putter has been designed to quickly diminish the amplitude of vibrations, moving both transversely and longitudinally of the club head, resulting from the club head striking a ball and to thereby improve the "feel" of the club when striking a ball and to enable the head of the club to more precisely drive a struck ball in the intended initial path of movement thereof. Still further, the putter has been constructed in a manner which also enables the club to be used by either right handed or left handed persons.

The main object of this invention is to provide a putter including a head construction which will function to substantially immediately dampen the amplitude of vibrations of the head, both longitudinally thereof and transversely of the head, resulting from impact of either side of the central portion of the head with a ball, to thus improve the "feel" of the putter and to insure as much accuracy as possible in the initial path of movement of a struck ball from the club head.

Another object of this invention is to provide a putter constructed in a manner whereby the inclined angle of the shaft or handle of the putter relative to the horizontal putter head may be adjusted to suit a given golfer within a predetermined range of adjustment.

Still another object of this invention is to provide a putter having a readily removable handle shaft to thereby enable a damaged shaft to be replaced independent of replacement of the entire putter.

A further object of this invention is to provide a putter including a horizontal head portion thereof designed specifically to prevent slight engagement of the head of the club with the ground from excessively adversely affecting the user's putting stroke.

Yet another object of this invention is to provide a putter which may be used with equal efficiency by both right and left handed golfers.

A final object of this invention to be specifically enumerated herein is to provide a putter in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
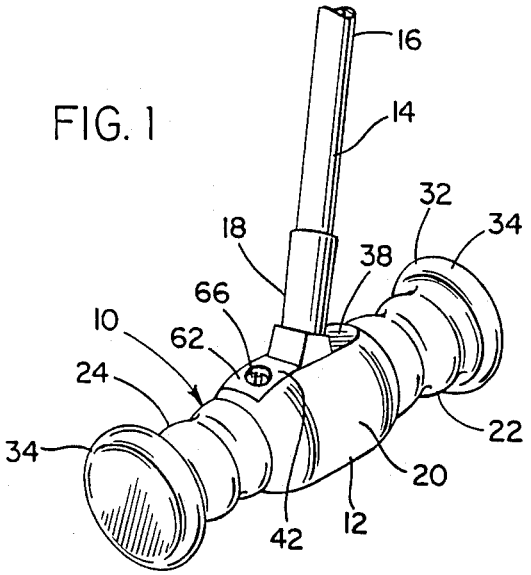
FIG. 1 is a perspective view of a first form of putter constructed in accordance with the present invention.
Figure 2:
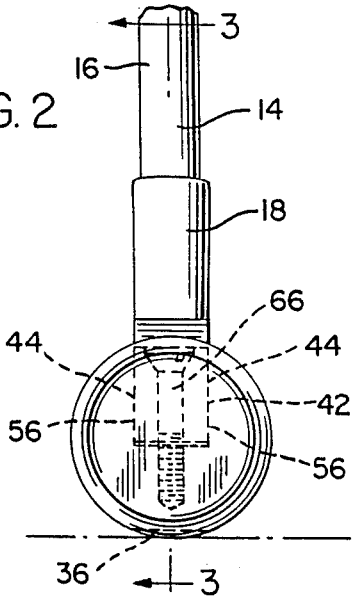
FIG. 2 is an enlarged end elevational view of the first form of putter as seen from the left side of FIG. 1.

Referring now more specifically to the drawings, the numeral 10 generally designates a first form of putter constructed in accordance with the present invention. The putter 10 includes a horizontally elongated generally cylindrical head 12 and an elongated upstanding handle or shaft 14 including upper and lower ends 16 and 18.

The head includes a generally cylindrical central portion 20 and opposite end portions 22 and 24. Each end portion 24 includes alternating longitudinally spaced large and small diameter zones 26, 28, 30, 32 and 34. Each of the large diameter zones 26 and 30 is smaller in diameter than the central portion 20, but the large diameter zone 34 is of at least the same diameter as the diameter of the central portion 20. The zones 26, 30 and 34 are convexly rounded in directions extending longitudinally of the head 12 and the small diameter zones 28 and 32 are concavely rounded in directions extending longitudinally of the head 12, the end portions 22 and 24 being substantially identical.

The underside of the central portion 20 is slightly shaved as at 36 to define a flat horizontal surface and the upper portion of the central portion 20 is more greatly shaved as at 38 to define a horizontal surface. Accordingly, the lower extremities of the large diameter zones 34 are disposed in a horizontal plane 40 spaced slightly beneath the horizontal surface 36 at the lower extremity of the central portion 20.

The central portion is provided with an upwardly opening slot 42 formed therein in any convenient manner such as by milling. The slot 42 extends longitudinally of the head 12 and includes parallel vertical opposite side surfaces 44. In addition, one end of the slot 42 includes a vertical end surface 46 and the bottom of the slot is defined by a planar horizontal bottom surface 48, the lower end portion of the surface 46 merges into a radiused surface 50 curving forwardly to merge smoothly into the bottom surface 48.

The lower end 18 of the handle or shaft 14 comprises a terminal end member 52 removably threadedly engaged on the upper end 16 and the terminal end member 52 includes a cylindrical peripheral end edge 54 of greater than 180° in angular extent. In addition, the terminal end member 52 includes a pair of opposite side surfaces 56 which parallel each other and the longitudinal center axis 58 of the upper end 16.

The opposite ends of the peripheral edge 54 merge into straight edges 60 convergent toward the upper end 16 and the terminal end member 52 is snugly received and seated within the slot 42 against the bottom surface 48 thereof with the peripheral edge 54 conforming to and abutting against the radiused surface 50. A downwardly tapering wedge block 62 is disposed in the end of the slot 42 between the terminal end member 52 and the end surface 64 of the slot 42 opposite the surface 46 and a clamp screw 66 passes downwardly through a bore 68 provided therefor in the wedge block 62 and is threadedly engaged in a threaded bore 70 formed in the head 12 and opening upwardly into the end of the slot 42 adjacent the end portion 24. In this manner, the screw 66 may be tightened to downwardly wedge the wedge block 62 in the end of the slot 42 adjacent the end portion 24 and tightly clamp the lower end of the terminal end member 52 within the end of the slot 42 adjacent the end portion 22.

Figure 3:
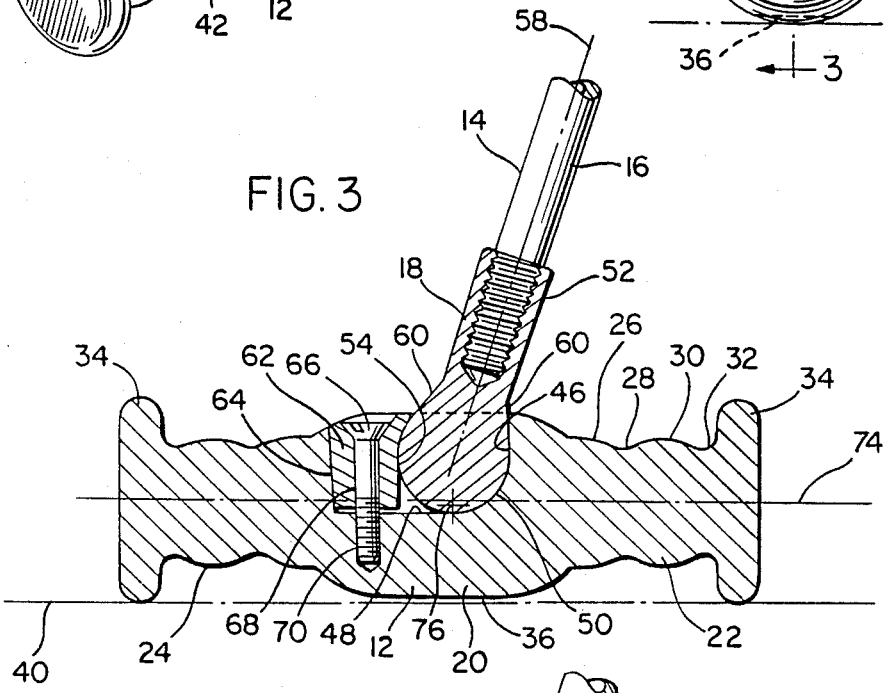
FIG. 3 is a fragmentary vertical sectional view taken substantially upon the plane indicated by the section line 3—3 of FIG. 2.

As shown in FIG. 3, the upper end 16 is inclined a maximum of 22° relative to the vertical, but the screw 66 may be loosened and the inclination of the upper end 16 relative to the vertical may be reduced to a minimum of 16° relative to the vertical, the convergent surfaces 60 of the terminal end member 52 engaging the surface 46 and the opposing upper surface portion of the wedge block 62 to define maximum and minimum inclined positions of the handle or shaft 14 relative to a vertical plane disposed normal to the longitudinal center line 74 of the head 12.

Inasmuch as the uper portion of the center portion 20 is shaved a greater amount than the lower portion of the center portion 20, the center of gravity 76 of the head 12 is spaced below the center line 74.

Further, the center portion 20 is identically convexly curved on its opposite laterally facing sides to thereby enable the putter 10 to be used by either a right handed person or a left handed person. Still further, the inclination of the handle or shaft 14 may be adjusted as previously described. In addition, the alternating diameter zones 26, 28, 30, 32 and 34 serve to quickly dampen the amplitude of vibrations of the head 12 (as a result of the head 12 striking a ball) extending both transversely and longitudinally of the head 12. This results in the "feel" of the club 10 to a golfer being improved and insures the greatest possible accuracy in the initial path of movement of a ball being struck by the club head 12.

The lower peripheral portions of the large diameter zones 34 act as smooth skids in the event they contact the ground or brush the top of closely cropped grass on a putting green to thereby insure further accuracy of a putting stroke. Still further, the placement of the center of gravity 76 of the head 12 below the longitudinal center line 74 of the club head 12 further enhances the "feel" of the putter 10 to a golfer.

Inasmuch as the terminal end member is removably supported from the upper end 16 of the handle or shaft 14, the upper end 16 may be readily replaced as desired, without changing the inclination of the terminal end member 52 relative to the head 12.

The head 12, end member 52 and upper end 16 of the handle or shaft 14 may be constructed of any suitable materials. Also, according to the desires of a golfer, the handle or shaft 14 may be constructed of materials of greater density than the material used in construction of the head 12 or of materials less dense than the material of which the head 12 is constructed.

Figure 4:
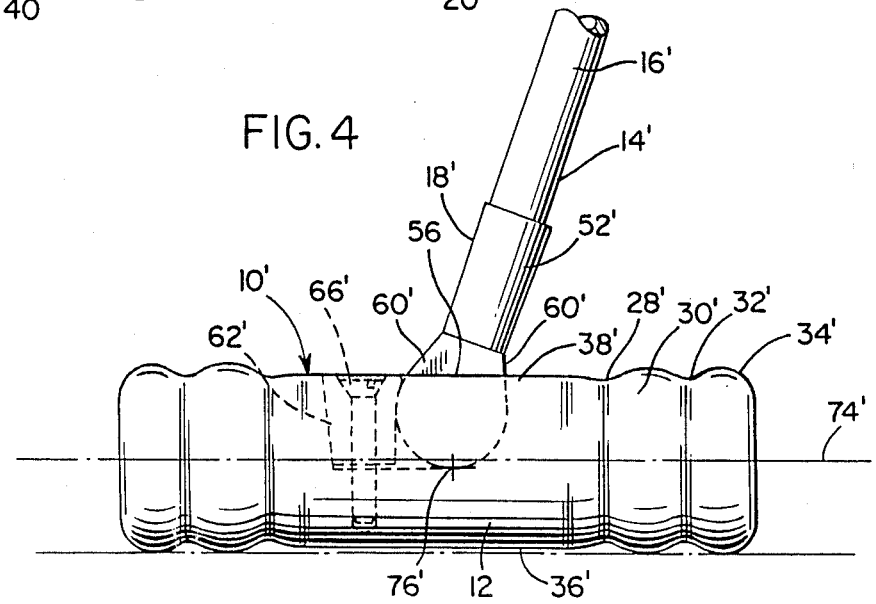
FIG. 4 is a fragmentary side elevational view of a second form of putter constructed in accordance with the present inveniton.

With attention now invited more specifically to FIG. 4 of the drawings, a modified form of putter is referred to in general by the reference numeral 10'. The putter 10' includes many of the features incorporated in the putter 1 and prime reference numerals are used to designate those portions of the putter 10' corresponding to various portions of the putter 10. However, the putter 10' differs from the putter 10 in that the large diameter zones 30' and 34' thereof are of the same diameter and the small diameter zones 28' and 32' thereof are of the same diameter. Otherwise, the putter 10' is substantially similar in "feel" during a putting stroke and affords maximum accuracy of the initial path of movement of a ball struck by the head 12' of the putter 10'.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A golf putter including a horizontally elongated, generally cylindrical head including opposite ends, an elongated upstanding handle having upper and lower ends, mounting means mounting said lower end from said head centrally intermediate said opposite ends and with said handle inclined relative to the vertical toward one end of said head, said head including a substantially cylindrical central portion and cylindrical opposite end portions, said opposite end portions including alternating longitudinally spaced zones of large and small diameter cross section with the terminal ends of said end portions comprising large diameter zones of said end portions and the last mentioned large diameter zones convexly rounded in directions extending longitudinally of said head, said central portion and end portions being coaxial, the undersurfaces of said terminal ends lying in a horizontal plane above which the undersurface of said central portion is spaced.

2. The golf putter of claim 1 wherein said small diameter zones of said opposite end portions are concavely rounded in directions extending longitudinally of said head.

3. The golf putter of claim 2 wherein said large diameter terminal ends are greater in diameter than the remaining large diameter zones.

4. The golf putter of claim 2 wherein said large diameter terminal ends are of the same diameter as the remaining large diameter zones.

5. The golf putter of claim 1 wherein the upper extremity of said central portion is shaved, slightly, whereby the center of mass of said head is disposed below the center axis of said head.

6. The golf putter of claim 5 wherein the lower extremity of said central portion is shaved, to a lesser extent than the amount said upper extremity if shaved.

7. The golf putter of claim 1 wherein said mounting means includes adjustment means operative to enable the incline of said handle relative to the vertical and said horizontal head to be adjusted.

8. The golf putter of claim 7 wherein said mounting means includes means operative to limit the adjustment of the incline of said handle relative to the vertical between positions with said handle inclined 16° and 22° relative to the vertical when said head is horizontally disposed.

9. A golf putter including a horizontally elongated, generally cylindrical head including opposite ends, an elongated upstanding handle having upper and lower ends, mounting means mounting said lower end from said head centrally intermediate said opposite ends and with said handle inclined relative to the vertical toward one end of said head, said head including a substantially cylindrical central portion and substantially cylindrical opposite end portions, said mounting means including an elongated upwardly opening slot formed in said central portion and extending longitudinally of said head, said slot including substantially parallel sides, said lower end of said handle including an enlarged disc-shaped terminus thereon including generally parallel opposite side surfaces and a generally convex partially cylindrical peripheral surface of greater than 180° in angular extent and whose ends merge into straight marginal surfaces convergent toward said upper end of said handle and are similarly inclined relative to the longitudinal center axis of said handle, said slot including a generally horizontal bottom surface and a first end adjacent said one end of said head including a generally vertical first end surface terminating downwardly in a radius surface curving toward said other end of said head and merging into the bottom surface of said slot, said slot including an upstanding second end surface opposite said first end surface, said terminus being snugly received downwardly in said first end of said slot with said convex cylindrical peripheral surface conforming to the radius of and engaging said radius surface, a downwardly tapering wedge block downwardly inserted into said slot between said second end surface and said terminus, and means operatively connected between said wedge block and said head releasably and forceably downwardly wedging said wedge block between said second end surface and said terminus.

10. The golf putter of claim 9 wherein said mounting means includes adjustment means operative to enable the incline of said handle relative to the vertical and said horizontal head to be adjusted.

11. The golf putter of claim 10 wherein said mounting means includes limit means operative to limit the adjustment of the incline of said handle relative to the vertical between positions with said handle inclined 16° and 22° relative to the vertical when said head is horizontally disposed.

12. The golf putter of claim 11 wherein said limit means includes said convergent marginal surfaces of said terminus and engagement thereof with said first end surface and the surface of said sedge block opposing said terminus.

13. The golf putter of claim 9 wherein said opposite end portions of said head include alternating longitudinally spaced zones of large and small diameter cross section with the terminal ends of said end portions comprising large diameter zones of said end portions and the last mentioned large diameter zones convexly rounded in directions extending longitudinally of said head, said central portion and end portions being coaxial, the undersurfaces of said terminal ends lying in a horizontal plane above which the undersurface of said central portion is spaced.

14. The golf putter of claim 13 wherein said small diameter zones of said opposite end portions are concavely rounded in directions extending longitudinally of said head.

15. The golf putter of claim 14 wherein said large diameter terminal ends are greater in diameter than the remaining large diameter zones.

16. The golf putter of claim 14 wherein said large diameter terminal ends are of the same diameter as the remaining large diameter zones.

17. The golf putter of claim 13 wherein the upper extremity of said central portion is shaved, slightly, whereby the center of mass of said head is disposed below the center axis of said head.

18. The golf putter of claim 17 wherein the lower extremity of said central portion is shaved, to a lesser extent than the amount said upper extremity if shaved.

* * * * *